US008991486B2

(12) United States Patent
Acosta et al.

(10) Patent No.: US 8,991,486 B2
(45) Date of Patent: Mar. 31, 2015

(54) REMOTELY ACTIVATED DOWN HOLE SYSTEMS AND METHODS

(75) Inventors: Frank V. Acosta, Duncan, OK (US); Lonnie Helms, Duncan, OK (US); Nicholas Frederick Budler, Marlow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 571 days.

(21) Appl. No.: 13/414,016

(22) Filed: Mar. 7, 2012

(65) Prior Publication Data

US 2013/0233570 A1 Sep. 12, 2013

(51) Int. Cl.

| | |
|---|---|
| ***E21B 34/14*** | (2006.01) |
| ***E21B 23/06*** | (2006.01) |
| *E21B 34/00* | (2006.01) |
| *E21B 33/128* | (2006.01) |

(52) U.S. Cl.

CPC ..... *E21B 23/06* (2013.01); *E21B 34/14* (2013.01); *E21B 2034/007* (2013.01); *E21B 33/128* (2013.01)

USPC ..... 166/120

(58) Field of Classification Search

CPC . E21B 34/14; E21B 2034/007; E21B 33/128; E21B 23/06

USPC ..... 166/120, 332.1, 334.1, 383, 386

See application file for complete search history.

(56) References Cited

U.S. PATENT DOCUMENTS

| | | | | |
|---|---|---|---|---|
| 3,112,796 | A | 12/1963 | Myers | |
| 7,216,713 | B2 * | 5/2007 | Read, Jr. | 166/319 |
| 2003/0217850 | A1 * | 11/2003 | Shaw et al. | 166/374 |
| 2005/0056417 | A1 * | 3/2005 | Porter et al. | 166/123 |
| 2013/0292137 | A1 * | 11/2013 | Lauderdale | 166/386 |

FOREIGN PATENT DOCUMENTS

WO 2013134013 A2 9/2013

OTHER PUBLICATIONS

International Search Report and Written Opinion for PCT/US2013/27853 dated Jun. 11, 2014.

* cited by examiner

*Primary Examiner* — Nicole Coy
*Assistant Examiner* — Kristyn Hall
(74) *Attorney, Agent, or Firm* — McDermott Will & Emery LLP; John W. Wustenberg

(57) ABSTRACT

Systems and methods for remotely setting a down hole device. The system includes a base pipe having inner and outer radial surfaces and defining one or more pressure ports extending between the inner and outer radial surfaces. An internal sleeve is arranged against the inner radial surface and slidable between a closed position, where the internal sleeve covers the one or more pressure ports, and an open position, where the one or more pressure ports are exposed to an interior of the base pipe. A trigger housing is disposed about the base pipe and defines an atmospheric chamber in fluid communication with the one or more pressure ports. A piston port cover is disposed within the atmospheric chamber and moveable between blocking and exposed positions. A well-bore device is used to engage and move the internal sleeve into the open position by applying predetermined axial force to the internal sleeve.

20 Claims, 2 Drawing Sheets

REMOTELY ACTIVATED DOWN HOLE SYSTEMS AND METHODS

BACKGROUND

The present invention relates to systems and methods used in down hole applications. More particularly the present invention relates to the remote setting of a down hole tool in various down hole applications.

In the course of treating and preparing a subterranean well for production, down hole tools, such as well packers, are commonly run into the well on a tubular conveyance such as a work string, casing string, or production tubing. The purpose of the well packer is not only to support the production tubing and other completion equipment, such as sand control assemblies adjacent to a producing formation, but also to seal the annulus between the outside of the tubular conveyance and the inside of the well casing or the wellbore itself. As a result, the movement of fluids through the annulus and past the deployed location of the packer is substantially prevented.

Some well packers are designed to be set using complex electronics that often fail or may otherwise malfunction in the presence of corrosive and/or severe down hole environments. Other well packers require that the ambient conditions in the well be significantly altered in order to obtain adequate hydrostatic pressures to properly set the packer. While reliable in some applications, these and other methods of setting well packers add additional and unnecessary complexity and cost to the pack off process.

SUMMARY OF THE INVENTION

The present invention relates to systems and methods used in down hole applications. More particularly the present invention relates to the remote setting of a down hole tool in various down hole applications.

In some aspects of the disclosure, a system is disclosed. The system may include a base pipe having an inner radial surface and an outer radial surface and defining one or more pressure ports extending between the inner and outer radial surfaces. The system may also include an internal sleeve arranged against the inner radial surface of the base pipe and slidable between a closed position, where the internal sleeve covers the one or more pressure ports, and an open position, where the one or more pressure ports are exposed to an interior of the base pipe. The system further includes a trigger housing disposed about the outer radial surface of the base pipe and defining an atmospheric chamber in fluid communication with the one or more pressure ports, and a piston port cover disposed within the atmospheric chamber and moveable between a blocking position and an exposed position. The system may also include a wellbore device configured to engage and move the internal sleeve into the open position by applying a predetermined axial force to the internal sleeve.

In other aspects of the disclosure, a trigger mechanism for setting a down hole tool disposed about a base pipe is disclosed. The trigger mechanism may include an internal sleeve arranged within the base pipe and slidable between a closed position and an open position. The base pipe may define one or more pressure ports. The trigger mechanism may also include a trigger housing disposed about the base pipe and defining an atmospheric chamber in fluid communication with the one or more pressure ports. The trigger mechanism may further include a piston port cover disposed within the atmospheric chamber and moveable between a blocking position, where the piston port cover occludes a hydrostatic conduit in fluid communication with a hydrostatic chamber, and an exposed position, where the hydrostatic conduit is exposed and provides fluid communication between the hydrostatic chamber and the atmospheric chamber.

In yet other aspects of the disclosure, a method for remotely setting a down hole tool disposed about a base pipe is disclosed. The method may include engaging an internal sleeve arranged within the base pipe with a wellbore device. The internal sleeve may be slidable between a closed position and an open position, and the base pipe may define one or more pressure ports. The method may also include applying a predetermined axial force on the internal sleeve with the wellbore device in order to move the internal sleeve into the open position and thereby expose the one or more holes to an interior of the base pipe, and allowing an influx of fluid from the interior of the base pipe into an atmospheric chamber via the one or more holes. The atmospheric chamber may be defined by a trigger housing disposed about the base pipe. The method may further include moving a piston port cover arranged within the atmospheric chamber from a blocking position into an exposed position using the influx of fluid. In the exposed position, a hydrostatic conduit may be exposed and provide fluid communication between the atmospheric chamber and a hydrostatic chamber. The method may also include allowing an influx of wellbore fluids into the hydrostatic chamber to move a hydrostatic piston arranged within the hydrostatic chamber. The hydrostatic piston may be configured to set the down hole tool.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to those skilled in the art and having the benefit of this disclosure.

DETAILED DESCRIPTION

The present invention relates to systems and methods used in down hole applications. More particularly the present invention relates to the remote setting of a down hole tool in various down hole applications.

As will be discussed in detail below, several advantages are gained through the systems and methods disclosed herein. For example, the disclosed systems and methods initiate and set a down hole tool, such as a well packer, in order to isolate the annular space defined between a wellbore and a base pipe (e.g., production string), thereby helping to prevent the migration of fluids through a cement column and to the surface. The down hole tool is mechanically-set without the use of electronics or signaling means. Rather, the down hole tool takes advantage of the hydrostatic pressure differential between the ambient environment surrounding the tool itself and within the base pipe. Consequently, the disclosed systems and methods simplify the setting process and reduce potential problems that would otherwise prevent the packer or down hole tool from setting. To facilitate a better understanding of the present invention, the following examples are given. It should be noted that the examples provided are not to be read as limiting or defining the scope of the invention.

Figure 1:
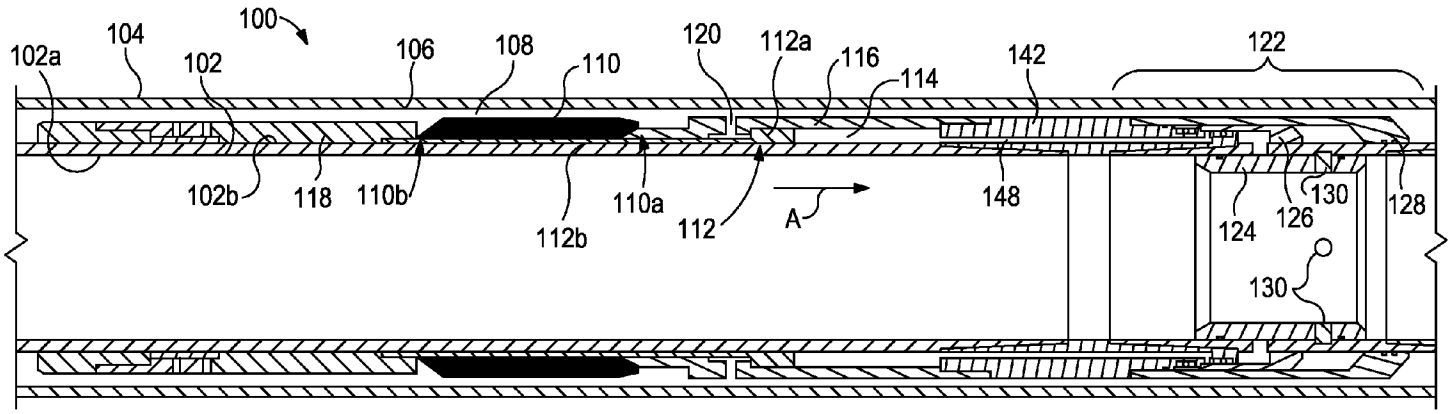
FIG. 1 illustrates a cross-sectional view of a portion of a base pipe and accompanying trigger mechanism, according to one or more embodiments disclosed.

Referring to FIG. 1, illustrated is a cross-sectional view of an exemplary system 100, according to one or more embodiments. The system 100 may include a base pipe 102 extending within a wellbore 104 that has been drilled into the Earth's surface to penetrate various earth strata containing, for example, hydrocarbon formations. It will be appreciated that the system 100 is not limited to any specific type of well, but may be used in all types, such as vertical wells, horizontal wells, multilateral (e.g., slanted) wells, combinations thereof, and the like. A casing 106 may be disposed within the wellbore 104 and thereby define an annulus 108 between the casing 106 and the base pipe 102. The casing 106 forms a protective lining within the wellbore 104 and may be made from materials such as metals, plastics, composites, or the like. In some embodiments, the casing 106 may be expanded or unexpanded as part of an installation procedure and/or may be segmented or continuous. In at least one embodiment, the casing 106 may be omitted and the annulus 108 may instead be defined between the inner wall of the wellbore 104 and the base pipe 102.

The base pipe 102 may include one or more tubular joints, having metal-to-metal threaded connections or otherwise threadedly joined to form a tubing string. In other embodiments, the base pipe 102 may form a portion of a coiled tubing. The base pipe 102 may have a generally tubular shape, with an inner radial surface 102*a* and an outer radial surface 102*b* having substantially concentric and circular cross-sections. However, other configurations may be suitable, depending on particular conditions and circumstances. For example, some configurations of the base pipe 102 may include offset bores, sidepockets, etc. The base pipe 102 may include portions formed of a non-uniform construction, for example, a joint of tubing having compartments, cavities or other components therein or thereon. Moreover, the base pipe 102 may be formed of various components, including, but not limited to, a joint of casing, a coupling, a lower shoe, a crossover component, or any other component known to those skilled in the art. In some embodiments, various elements may be joined via metal-to-metal threaded connections, welded, or otherwise joined to form the base pipe 102. When formed from casing threads with metal-to-metal seals, the base pipe 102 may omit elastomeric or other materials subject to aging, and/or attack by environmental chemicals or conditions.

The system 100 may further include at least one down hole tool 110 coupled to or otherwise disposed about the base pipe 102. In some embodiments, the down hole tool 110 may be a well packer. In other embodiments, however, the down hole tool 110 may be a casing annulus isolation tool, a stage cementing tool, a multistage tool, formation packer shoes or collars, combinations thereof, or any other down hole tool. As the base pipe 102 is run into the well, the system 100 may be adapted to substantially isolate the down hole tool 110 from any fluid actions from within the casing 106, thereby effectively isolating the down hole tool 110 so that circulation within the annulus 108 is maintained until the down hole tool 110 is properly actuated.

In one or more embodiments, the down hole tool 110 may include a standard compression-set element that expands radially outward when subjected to compression. Alternatively, the down hole tool 110 may include a compressible slip on a swellable element, a compression-set element that partially collapses, a ramped element, a cup-type element, a chevron-type seal, one or more inflatable elements, an epoxy or gel squirted into the annulus 108, combinations thereof, or other sealing elements.

The down hole tool 110 may be disposed about the base pipe 102 in a number of ways. For example, in some embodiments the down hole tool 110 may directly or indirectly contact the outer radial surface 102*b* of the base pipe 102. In other embodiments, however, the down hole tool 110 may be arranged about or otherwise radially-offset from another component of the base pipe 102. For example, the system 100 may include a hydrostatic piston 112 arranged external to the base pipe 102. As illustrated, the hydrostatic piston 112 may include a piston portion 112*a* housed within a hydrostatic chamber 114 and a stem portion 112*b* that extends axially from the piston portion 112*a* and interposes the down hole tool 110 and the base pipe 102. In one or more embodiments, the hydrostatic piston 112 provides the required energy to properly set the down hole tool 110.

The hydrostatic chamber 114 may be at least partially defined by a ramped retainer element 116 arranged about the base pipe 102 adjacent a first axial end 110*a* of the down hole tool 110. One or more inlet ports 120 may be defined in the ramped retainer element 116 and provide fluid communication between the annulus 108 and the hydrostatic chamber 114. The stem portion 112*b* may be coupled to a compression sleeve 118 arranged adjacent to, and potentially in contact with, a second axial end 110*b* of the down hole tool 110.

The hydrostatic chamber 114 contains fluid under hydrostatic pressure from the annulus 108, and the hydrostatic piston 112 remains in fluid equilibrium until a pressure differential is experienced across the piston portion 112*a*. In one embodiment, the pressure differential experienced across the piston portion 112*a* forces the hydrostatic piston 112 to axially translate in a direction A within the hydrostatic chamber 114 as it seeks pressure equilibrium once again. As the hydrostatic piston 112 translates in direction A, the compression sleeve 118 coupled to the stem portion 112*b* is forced up against the second axial end 110*a* of the down hole tool 110, thereby compressing and radially expanding the down hole tool 110. As the down hole tool 110 expands radially, it may engage the wall of the casing 106 and effectively isolate portions of the annulus 108 above and below the down hole tool 110.

The system 100 may also include a trigger mechanism 122. In some embodiments, the trigger mechanism 122 may be activated or otherwise actuated in order to realize a pressure differential sufficient to translate the hydrostatic piston 112, and thereby cause the down hole tool 110 to set. Among other components described below, the trigger mechanism 122 may include an internal sleeve 124, a piston port cover 126, and a trigger housing 128. The internal sleeve 124 may be disposed against the inner radial surface 102*a* of the base pipe 102 and secured thereto using one or more pins 130 spaced circumferentially about the inner radial surface 102*a*. Although three pins 130 are shown in FIG. 1, it will be appreciated that any number of pins 130 may be used without departing from the scope of the disclosure. In some embodiments, the pins 130 may be omitted and instead replaced with a shear ring (not shown) that serves substantially the same purpose in securing the internal sleeve 124 to the base pipe 102.

Figure 2:
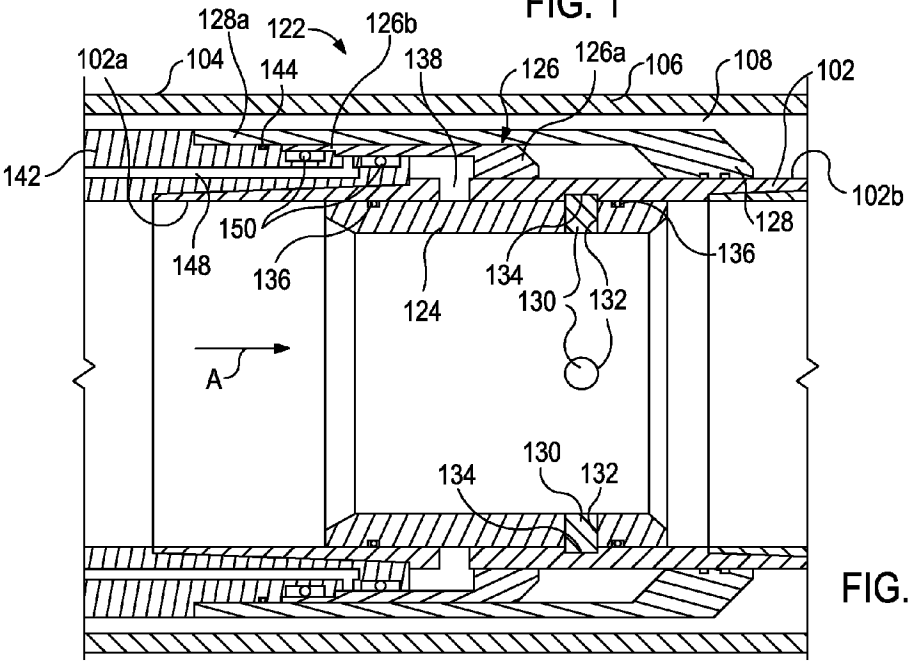
FIG. 2 illustrates an enlarged view of the trigger mechanism shown in FIG. 1, according to one or more embodiments disclosed.

Referring to FIG. 2, with continued reference to FIG. 1, illustrated is an enlarged view of the trigger mechanism 122, according to one or more embodiments. As illustrated, the pins 130 may extend through concentric and corresponding holes 132 defined in the internal sleeve 124 and holes 134 defined in the base pipe 102. In some embodiments, the pins 130 are threaded into either or each of the base pipe 102 and/or the internal sleeve 124. In other embodiments, the pins 130 are attached to either or each of the base pipe 102 and/or the internal sleeve 124 by welding, brazing, adhesives, combinations thereof, or other attachment means. One or more sealing components 136 may be arranged between the internal sleeve 124 and the inner radial surface 102*a* of the base pipe 102 in order to provide a fluid-tight seal therebetween. In some embodiments, the sealing components 136 may be o-rings. In other embodiments, the sealing components 136 may be other types of seals known to those skilled in the art.

Figure 3:
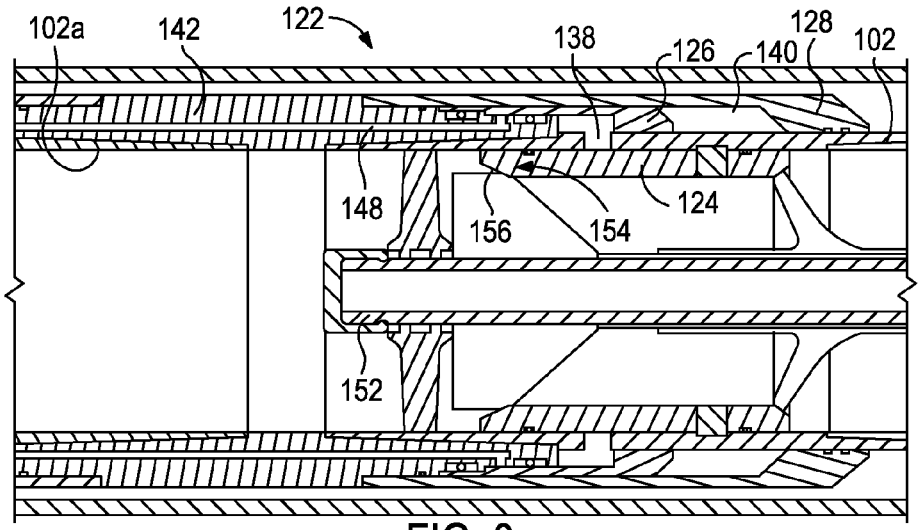
FIG. 3 illustrates a stage of activation of the trigger mechanism, according to one or more embodiments disclosed.
Figure 4:
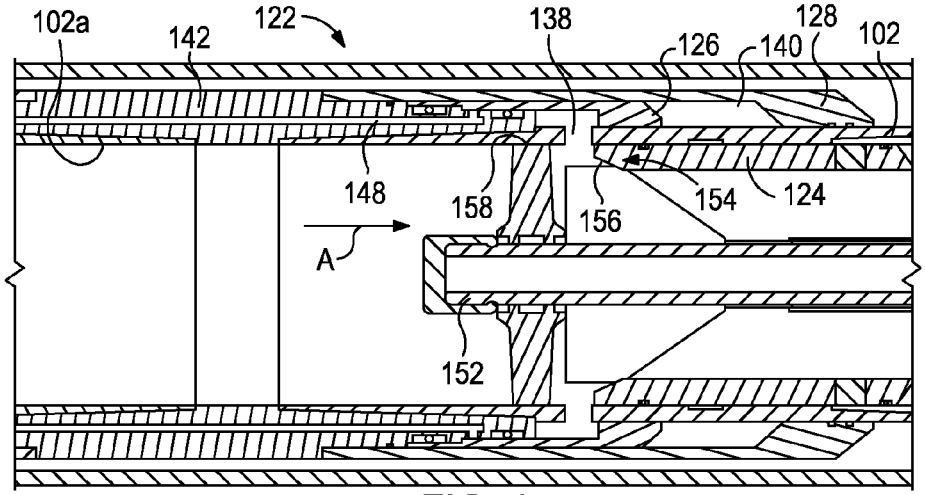
FIG. 4 illustrates another stage of activation of the trigger mechanism, according to one or more embodiments disclosed.
Figure 5:
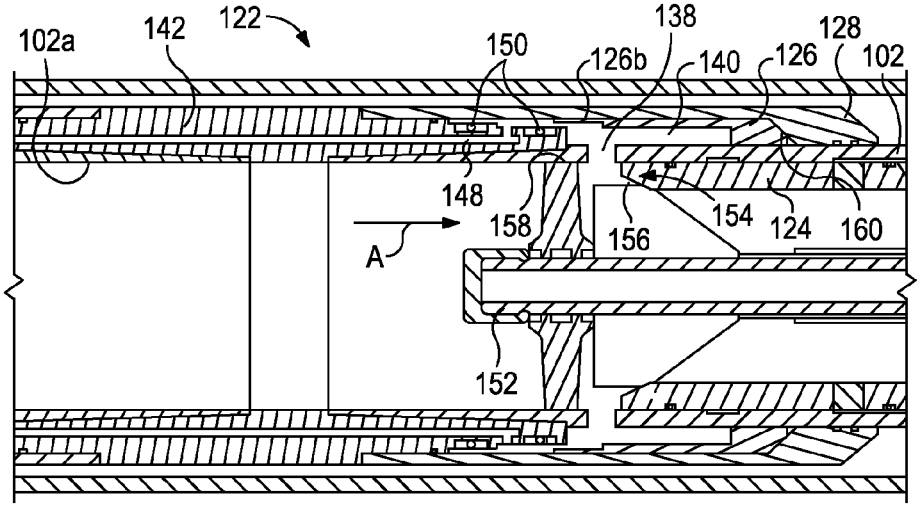
FIG. 5 illustrates yet another stage of activation of the trigger mechanism, according to one or more embodiments disclosed.

In response to a predetermined axial force applied to the internal sleeve 124 in the direction A, the pins 130 may be configured to shear such that the internal sleeve 124 is able to translate along the inner radial surface 102*a* of the base pipe 102. Specifically, the internal sleeve 124 may be slidable between a closed position, where the internal sleeve 124 effectively covers one or more pressure ports 138 defined in the base pipe 102, and an open position, where the one or more pressure ports 132 are uncovered or otherwise exposed to the interior of the base pipe 102. For example, FIGS. 1-3 show the internal sleeve 124 in its closed position, and FIGS. 4 and 5 show the internal sleeve 124 in its open position.

The trigger housing 128 may be disposed about the outer radial surface 102*b* of the base pipe 102 and have a first end 128*a* and a second end 128*b*. In conjunction with the base pipe 102, the trigger housing 128 at least partially defines an atmospheric chamber 140. At the first end 128*a*, the trigger housing 128 may be coupled to a hydraulic pressure transmission coupling 142. At its second end 128*b*, the trigger housing 128 may either directly or indirectly engage the outer radial surface 102*b* of the base pipe 102. At least one sealing component 144, such as an o-ring or the like, may be used to seal the connection between the first end 128*a* and the hydraulic pressure transmission coupling 142. Likewise, one or more sealing components 146 (two shown), such as o-rings or the like, may be used to seal the engagement between the second end 128*b* and the base pipe 102.

In at least one embodiment, the first end 128*a* is threaded onto the hydraulic pressure transmission coupling 142. In other embodiments, however, the first end 128*a* may be coupled to the hydraulic pressure transmission coupling 142 using, for example, mechanical fasteners or the like. The opposing end of the hydraulic pressure transmission coupling 142, as shown in FIG. 1, may be coupled, either threadedly or via mechanical fasteners, to the ramped retainer element 116. In some embodiments, the hydraulic pressure transmission coupling 142 may define a hydrostatic conduit 148 that provides fluid communication between the hydrostatic chamber 114 and the atmospheric chamber 140. The hydrostatic conduit 148 may be rifle-drilled directly into the hydraulic pressure transmission coupling 142. In other embodiments, however, the hydrostatic conduit 148 may be defined external to the hydraulic pressure transmission coupling 142, such as an external conduit adapted to connect the hydrostatic chamber 114 to the atmospheric chamber 140.

Before the trigger mechanism 122 is actuated, the atmospheric chamber 140 may be filled with a fluid generally at atmospheric pressure. For example, the atmospheric chamber 140 may be filled with air. In other embodiments, however, the atmospheric chamber 140 may be filled with other fluids such as, but not limited to, hydraulic fluid, water, oil, combinations thereof, or the like.

Still referring to FIG. 2, the piston port cover 126 may be disposed about the base pipe 102 and arranged within the atmospheric chamber 140. The piston port cover 126 may be made of aluminum, composite, steel, combinations thereof, or other rigid materials. In one embodiment, the piston port cover 126 may include a piston portion 126*a* and a sleeve portion 126*b* extending axially from the piston portion 126*a*. The piston port cover 126 may be movable within the atmospheric chamber 140 between a first, blocking position and a second, exposed position. Examples of the piston port cover 126 in the blocking position can be seen in FIGS. 1-4, and an example of the piston port cover 126 in its exposed position can be seen in FIG. 5.

In the blocking position, the sleeve portion 126*b* of the piston port cover 126 may substantially interpose portions of the hydraulic pressure transmission coupling 142 and the trigger housing 128. Moreover, in the blocking position, the sleeve portion 126*b* may substantially block or otherwise occlude the hydrostatic conduit 148 such that fluid communication between the hydrostatic chamber 114 and the atmospheric chamber 140 is substantially prevented. One or more sealing components 150, such as o-rings or the like, may be disposed between the hydraulic pressure transmission coupling 142 and the sleeve portion 126*b*, such that fluid leakage between the hydrostatic chamber 114 and the atmospheric chamber 140 is substantially prevented while the piston port cover 126 is in its blocking position.

In the exposed position, the piston port cover 126 may be shifted axially in direction A such that the sleeve portion 126*b* no longer blocks the hydrostatic conduit 148, thereby exposing the hydrostatic conduit 148 to the atmospheric chamber 140. As a result, fluid communication between the hydrostatic chamber 114 and the atmospheric chamber 140 may occur.

Referring now to FIGS. 3-5, with continued reference to FIGS. 1 and 2, illustrated are various stages of exemplary operation of the system 100, according to one or more embodiments. Specifically, FIGS. 3-5 illustrate the trigger mechanism 122 as it may be activated or actuated and thereby cause the down hole tool 110 (FIG. 1) to set. In FIG. 3, for example, illustrated is a wellbore device 152 that may be introduced or otherwise dropped down the well, within the base pipe 102, and configured to engage and move the internal sleeve 124. In at least one embodiment, the wellbore device 152 is a plug, as known by those skilled in the art. In other embodiments, however, the wellbore device 152 may be another type of down hole device such as, but not limited to, a ball or a dart. The wellbore device 152 may be made of, for example, aluminum, composite, rubber, combinations thereof, or the like.

In some embodiments, the wellbore device 152 may be configured to engage an upper end 154 of the internal sleeve 124. In FIG. 3, for example, the wellbore device 152 is biased against a seat 156 defined at the upper end 154 of the internal sleeve 124. In other embodiments, however, the wellbore device 152 may be configured to engage any portion of the internal sleeve 124. Likewise, any portion of the wellbore device 152 may be adapted to engage any corresponding portion of the internal sleeve 124, without departing from the scope of the disclosure. In yet other embodiments, the internal sleeve 124 may be hydraulically-operated, where a plug or similar device (not shown) is landed below the internal sleeve 124 and configured to shut off further fluid flow therebelow, and thereby allowing a pressure increase sufficient to cause the internal sleeve 124 to shift to an open position. Such an embodiment would be somewhat similar in design to the Type HES cementer opening seat, available through Halliburton Energy Services, Houston, Tex.

Referring to FIG. 4, illustrated is the trigger mechanism 122 showing the internal sleeve 124 moved into its open position. In order to move the internal sleeve 124 within the base pipe 102, the pins 130 must be sheared or otherwise removed from engagement with the base pipe 102. In some embodiments, the wellbore device 152 may be configured to apply a predetermined axial force to the internal sleeve 124 such that the pins 130 are sheared and the internal sleeve 124 is thereafter able to translate axially. As can be appreciated, the size and number of the pins 130 will define what magnitude of axial force is required to shear the pins 130 in order to move the internal sleeve 124. Accordingly, upon design of the system 100, the size and number of the pins 130 may be taken into account and thereby provide a user with the predetermined axial force necessary to shear the pins 130 and thereby move the internal sleeve 124 into its open position.

In some embodiments, the predetermined axial force may be applied to the internal sleeve 124 by increasing the fluid pressure in the base pipe 102. For instance, the wellbore device 152 may have an outer circumference 158 adapted to engage or otherwise substantially seal against the inner radial surface 102*a* of the base pipe 102. A fluid may be pumped from the surface and into the base pipe 102 such that the wellbore device 152 is forced against the internal sleeve 124. By increasing the pressure of the fluid within the base pipe 102, the axial force applied by the wellbore device 152 on the internal sleeve 124 correspondingly increases. Further increasing the pressure of the fluid within the base pipe 102 may achieve the predetermined axial force required to shear the pins 130 and thereby move the internal sleeve 124 into its open position. In other embodiments, however, the predetermined axial force may be applied to the internal sleeve 124 in other ways, such as a mechanical force applied to the wellbore device 152 and which transfers its force to the internal sleeve 124. In yet other embodiments, the internal sleeve 124 may be hydraulically-actuated, as discussed above. In yet further embodiments, a workstring or the like may be lowered into the well with an end adapted to fit into or otherwise engage the seat, whereby weight slacked off from above could serve to shift the internal sleeve 124 downward.

In other embodiments, the internal sleeve 124 may be attached to the base pipe 102 via a c-ring or collet (not shown), allowing the wellbore device 152 to be introduced into the system 100, such that when wellbore device 152 engages the internal sleeve 124 and shifts downward, the collet or c-ring may fall into a corresponding recess provided in the base pipe 102. Without being constrained by the c-ring or collet, the internal sleeve 124 may be allowed to shift sufficiently to expose the pressure ports 138.

Referring to FIG. 5, as the internal sleeve 124 is moved into its open position, the one or more pressure ports 138 become exposed and provide a conduit that fluidly communicates the atmospheric chamber 140 with the interior of the base pipe 102. Until the trigger mechanism 122 is actuated, the atmospheric chamber 140 may be substantially filled with air or another fluid at atmospheric pressure. Accordingly, once the pressure ports 138 are exposed, the pressurized fluids within the base pipe 102 may escape into the lower pressure atmospheric chamber 140. In some embodiments, the influx of the pressurized fluid from the base pipe 102 into the atmospheric chamber 140 may cause the piston port cover 126 to shift axially in direction A within the atmospheric chamber 140. In at least one embodiment, the piston port cover 126 may be shifted axially until engaging an inner surface 160 of the trigger housing 128.

Referring now to FIGS. 1 and 5, as the piston port cover 126 shifts in direction A, the seal provided by the sealing components 150 on the sleeve portion 126*b* is broken and the hydrostatic conduit 148 is thereby exposed to the atmospheric chamber 140. Exposing the hydrostatic conduit 148 to the atmospheric chamber 140 may provide a means for fluid communication between the hydrostatic chamber 114 and the atmospheric chamber 140. As a result, the higher pressure fluid from the hydrostatic chamber 114 flows into the lower pressure atmospheric chamber 140 and the hydrostatic equilibrium across the hydrostatic piston 112 is lost. Moreover, high pressure formation or wellbore fluids from the annulus 108 may also enter the hydrostatic chamber 114 via the one or more inlet ports 120 defined in the ramped retainer element 116. As the hydrostatic piston 112 attempts to regain hydrostatic equilibrium, it may move axially in direction A. The influx of the high pressure fluids via the inlet ports 120 may provide additional axial force on the hydrostatic piston 112, thereby forcing it further in direction A.

As the hydrostatic piston 112 moves axially in direction A, the compression sleeve 118 is forced up against the second axial end 110*a* of the down hole tool 110, thereby resulting in the compression and radial expansion of the down hole tool 110. As a result, the down hole tool 110 expands radially and engages the wall of the casing 106 to effectively isolate portions of the annulus 108 above and below the down hole tool 110.

Accordingly, the disclosed system 100 and related methods may be used to remotely set the down hole tool 110. The trigger mechanism 122 activates the setting action of the down hole tool 110 without the need of electronic devices or magnets, but instead relies on mechanical and fluid forces, especially ambient fluid pressures present around the tool 110 itself. Because the system 100 provides one or more pressure ports 138 defined within the base pipe 102, fluid communication between both the atmospheric chamber 140 and the hydrostatic chamber 114 is provided.

Methods of using the system 100 may include a method for remotely setting a down hole tool disposed about a base pipe. The method may include engaging an internal sleeve arranged within the base pipe with a wellbore device. The internal sleeve may be slidable between a closed position and an open position, and the base pipe may define one or more pressure ports. A predetermined axial force may be applied on the internal sleeve with the wellbore device in order to move the internal sleeve into the open position. In the open position, the one or more holes may be exposed to an interior of the base pipe. With the one or more holes exposed, a fluid from the interior of the base pipe may flow into an atmospheric chamber via the one or more holes. The atmospheric chamber may be defined by a trigger housing disposed about the base pipe. The method may further include moving a piston port cover arranged within the atmospheric chamber from a blocking position into an exposed position using the fluid from the interior of the base pipe. When the piston port cover is in its exposed position, a hydrostatic conduit becomes exposed and provides fluid communication between the atmospheric chamber and a hydrostatic chamber. With fluid communication between the atmospheric chamber and a hydrostatic chamber, wellbore fluids can flow into the hydrostatic chamber and thereby move a hydrostatic piston arranged therein. The hydrostatic piston may be configured to set the down hole tool.

In some embodiments, the predetermined axial force on the internal sleeve is applied by applying fluid pressure against the wellbore device. In other embodiments, the predetermined axial force on the internal sleeve is applied by simply applying a mechanical force on the wellbore device. Applying the predetermined axial force on the internal sleeve may include shearing one or more pins that secure the internal sleeve to the base pipe. In other embodiments, however, applying the predetermined axial force on the internal sleeve may include removing or otherwise breaking other types of engagements with the base pipe including, but not limited to shear rings, c-rings, collets, combinations thereof, or the like. In some embodiments, the method may further include sealing the hydrostatic conduit from communication with the atmospheric chamber when the piston port cover is in the closed position. Moreover, allowing an influx of wellbore fluids into the hydrostatic chamber may further include creating a pressure differential across the hydrostatic piston such that the hydrostatic piston translates within the hydrostatic chamber.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended due to the details of construction or design herein shown, other than as described in the claims below. It is therefore evident that the particular illustrative embodiments disclosed above may be altered, combined, or modified and all such variations are considered within the scope and spirit of the present invention. In addition, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

What is claimed is:

1. A system, comprising:

a base pipe having an inner radial surface and an outer radial surface and defining one or more pressure ports extending between the inner and outer radial surfaces;

an internal sleeve arranged against the inner radial surface of the base pipe and slidable between a closed position, where the internal sleeve covers the one or more pressure ports, and an open position, where the one or more pressure ports are exposed to an interior of the base pipe;

a trigger housing disposed about the outer radial surface of the base pipe and defining an atmospheric chamber in fluid communication with the one or more pressure ports;

a piston port cover disposed within the atmospheric chamber and moveable between a blocking position, where the piston port cover occludes a hydrostatic conduit, and an exposed position, where the piston port cover has moved to expose the hydrostatic conduit; and a wellbore device configured to engage and move the internal sleeve into the open position by applying a predetermined axial force to the internal sleeve.

2. The system of claim 1, wherein the internal sleeve is secured to the inner radial surface of the base pipe with one or more pins.

3. The system of claim 2, wherein the one or more pins are configured to shear when the predetermined axial force is applied to the internal sleeve.

4. The system of claim 1, further comprising a hydraulic pressure transmission coupling disposed about the base pipe and coupled to the target housing, wherein the hydrostatic conduit is defined within the hydraulic pressure transmission coupling and provides fluid communication between the atmospheric chamber and a hydrostatic chamber.

5. The system of claim 4, wherein:

when in the blocking position, the piston port cover occludes the hydrostatic conduit such that fluid communication between the atmospheric chamber and the hydrostatic chamber is prevented; and when in the exposed position, the piston port cover is shifted and the hydrostatic conduit is exposed to the atmospheric chamber, thereby facilitating fluid communication between the hydrostatic chamber and the atmospheric chamber.

6. The system of claim 5, further comprising:

a down hole tool disposed about the outer radial surface of the base pipe and having a first axial end and a second axial end;

a ramped retainer element disposed about the base pipe adjacent the first axial end and coupled to the hydraulic pressure transmission coupling, the ramped retainer element at least partially defining the hydrostatic chamber and further defining one or more inlet ports that provide fluid communication between the hydrostatic chamber and a wellbore annulus;

a hydrostatic piston having a piston portion disposed within the hydrostatic chamber and a stem portion extending axially from the piston portion; and a compression sleeve disposed about the outer radial surface of the base pipe adjacent the second axial end of the down hole tool and coupled to the stem portion of the hydrostatic portion, wherein, as a hydrostatic equilibrium across the piston portion is lost, the hydrostatic piston translates axially and compresses the down hole tool with the compression sleeve.

7. The system of claim 1, wherein the wellbore device is a well plug.

8. The system of claim 1, wherein the predetermined axial force on the internal sleeve may be realized by applying fluid pressure against the wellbore device.

9. A trigger mechanism for setting a down hole tool disposed about a base pipe, comprising:

an internal sleeve arranged within the base pipe and slidable between a closed position and an open position, the base pipe defining one or more pressure ports;

a trigger housing disposed about the base pipe and defining an atmospheric chamber in fluid communication with the one or more pressure ports; and a piston port cover disposed within the atmospheric chamber and moveable between a blocking position, where the piston port cover occludes a hydrostatic conduit in fluid communication with a hydrostatic chamber, and an exposed position, where the hydrostatic conduit is exposed and provides fluid communication between the hydrostatic chamber and the atmospheric chamber.

10. The trigger mechanism of claim 9, further comprising a wellbore device arranged within the base pipe and configured to engage and move the internal sleeve into the open position by applying a predetermined axial force to the internal sleeve.

11. The trigger mechanism of claim 10, wherein the predetermined axial force may be realized by applying fluid pressure on the wellbore device.

12. The trigger mechanism of claim 9, wherein the internal sleeve covers the one or more pressure ports when in the closed position and exposes the one or more pressure ports when in the open position.

13. The trigger mechanism of claim 9, further comprising a hydraulic pressure transmission coupling disposed about the base pipe and coupled to the target housing, wherein the hydrostatic conduit is defined within the hydraulic pressure transmission coupling.

14. The trigger mechanism of claim 13, wherein, when in the blocking position, at least a portion of the piston port cover interposes portions of the hydraulic pressure transmission coupling and the trigger housing.

15. A method for remotely setting a down hole tool disposed about a base pipe, comprising:

engaging an internal sleeve arranged within the base pipe with a wellbore device, the internal sleeve being slidable between a closed position and an open position, and the base pipe defining one or more pressure ports;

applying a predetermined axial force on the internal sleeve with the wellbore device in order to move the internal sleeve into the open position and thereby expose the one or more pressure ports to an interior of the base pipe;

allowing an influx of fluid from the interior of the base pipe into an atmospheric chamber via the one or more pressure ports, the atmospheric chamber being defined by a trigger housing disposed about the base pipe;

moving a piston port cover arranged within the atmospheric chamber from a blocking position into an exposed position using the influx of fluid, wherein in the exposed position a hydrostatic conduit is exposed and provides fluid communication between the atmospheric chamber and a hydrostatic chamber; and allowing an influx of wellbore fluids into the hydrostatic chamber to move a hydrostatic piston arranged within the hydrostatic chamber, the hydrostatic piston being configured to set the down hole tool.

16. The method of claim 15, wherein applying the predetermined axial force on the internal sleeve comprises applying fluid pressure against the wellbore device.

17. The method of claim 15, wherein applying the predetermined axial force on the internal sleeve comprises applying a mechanical force on the wellbore device.

18. The method of claim 15, wherein applying the predetermined axial force on the internal sleeve comprises shearing one or more pins that secure the internal sleeve to the base pipe.

19. The method of claim 15, further comprising sealing the hydrostatic conduit from communication with the atmospheric chamber when the piston port cover is in the closed position.

20. The method of claim 15, wherein allowing an influx of wellbore fluids into the hydrostatic chamber further comprises creating a pressure differential across the hydrostatic piston such that the hydrostatic piston translates within the hydrostatic chamber.

* * * * *